US010543606B2

(12) United States Patent
Schatz

(10) Patent No.: US 10,543,606 B2
(45) Date of Patent: Jan. 28, 2020

(54) HAIR TRIMMING METHOD AND APPARATUS

(71) Applicant: James Schatz, Cypress, TX (US)

(72) Inventor: James Schatz, Cypress, TX (US)

( * ) Notice: Subject to any disclaimer, the term of this patent is extended or adjusted under 35 U.S.C. 154(b) by 71 days.

(21) Appl. No.: 15/197,316

(22) Filed: Jun. 29, 2016

(65) Prior Publication Data

US 2016/0375594 A1 Dec. 29, 2016

Related U.S. Application Data

(60) Provisional application No. 62/186,212, filed on Jun. 29, 2015.

(51) Int. Cl.
*B26B 19/04* (2006.01)
*B26B 19/14* (2006.01)
*B26B 19/38* (2006.01)

(52) U.S. Cl.
CPC ..... *B26B 19/148* (2013.01); *B26B 19/3853* (2013.01)

(58) Field of Classification Search
CPC . B26B 19/148; B26B 19/3853; B26B 19/386; B26B 19/3846
USPC ..... D8/49–54
See application file for complete search history.

(56) References Cited

U.S. PATENT DOCUMENTS 1,229,824 A 6/1917 Tewelow
1,266,868 A 5/1918 Sheehan
1,522,298 A 1/1925 Goodrich
1,799,907 A 4/1931 Kaufmann
1,801,889 A 4/1931 Ventimiglia
1,831,579 A * 11/1931 Sneed ..... B26B 19/00 30/29.5
1,973,631 A 9/1934 Johnson
2,028,022 A 1/1936 Sieminski
2,055,129 A 9/1936 Hill et al.
2,074,020 A 3/1937 Marholt
2,089,486 A 8/1937 Kuhn
2,111,861 A 3/1938 Knapp
2,139,680 A 12/1938 Heinrich
2,191,073 A 2/1940 Fishbein et al.
2,235,326 A 3/1941 Muros
2,275,180 A 3/1942 Holsclaw
2,488,436 A 11/1949 Santoro, Sr.
3,284,894 A 11/1966 Ryan
3,299,507 A 1/1967 Mistretta
3,381,373 A 5/1968 Brown
3,574,936 A 4/1971 Bullerman
3,731,379 A 5/1973 Williams
3,829,966 A 8/1974 Owens
4,162,574 A 7/1979 Johnston
4,430,794 A * 2/1984 Miller ..... B26B 19/148 30/29.5

(Continued)

FOREIGN PATENT DOCUMENTS

CN 104797387 A 7/2015
DE 202014004101 U1 * 6/2014

(Continued)

*Primary Examiner* — Stephen Choi
(74) *Attorney, Agent, or Firm* — Christopher McKeon; Arnold & Saunders, LLP

(57) ABSTRACT

The present disclosure relates to an apparatus and method for trimming hairs by rotating a housing on a handle that contains one or more razor blades angled for shaving adjacent hairs.

17 Claims, 10 Drawing Sheets

(56) References Cited

U.S. PATENT DOCUMENTS

| | | | |
|---|---|---|---|
| 4,735,605 | A | 4/1988 | Swartz |
| 4,976,030 | A | 12/1990 | Boyd |
| 4,980,974 | A | 1/1991 | Radcliffe |
| 5,012,576 | A | 5/1991 | Johannesson |
| 5,655,301 | A | 8/1997 | Dickson |
| 6,505,403 | B1 | 1/2003 | Andrews |
| 7,111,398 | B1 | 9/2006 | Park |
| 7,322,108 | B2 | 1/2008 | Caldwell |
| 7,730,619 | B2 | 6/2010 | Ozenick |
| 7,870,675 | B1 | 1/2011 | Della Polla |
| 9,266,245 | B2 | 2/2016 | Kammer et al. |
| 2003/0106220 | A1 | 6/2003 | Caldwell |
| 2005/0028369 | A1 | 2/2005 | Cocchiarella et al. |
| 2005/0144783 | A1 | 7/2005 | Yiu |
| 2008/0072431 | A1 | 3/2008 | Ozenick |

FOREIGN PATENT DOCUMENTS

| | | | | |
|---|---|---|---|---|
| EP | 0964775 | A1 | | 12/1999 |
| EP | 1296807 | A2 | | 4/2003 |
| ES | 2157737 | A1 | * | 8/2001 |
| JP | 2005211356 | A | * | 8/2005 |
| WO | 1998057783 | A1 | | 12/1998 |
| WO | 2014074577 | A1 | | 5/2014 |

* cited by examiner

HAIR TRIMMING METHOD AND APPARATUS

RELATED APPLICATIONS

This application claims priority to U.S. Provisional Application No. 62/186,212, filed Jun. 29, 2015.

BACKGROUND

The invention generally relates to methods and various apparatus for trimming hair.

Several different designs have been used for shaving facial hairs and other human body hairs including straight razors, electric razors, safety razors, disposable razors, wax, laser hair removal, tweezers, and chemical treatments. None of these designs are optimal for shaving inner surfaces such as in the nostril or the ear. For inner areas such as nostrils and ears electrical razors may be used that have an electrically driven blade mechanism within a blade guard that remains stationary with respect to the surface being shaved. Problems with these designs is that they are susceptible to water when cleaning, they do not shave as close as possible, and they are expensive. A need exist for a safe, simple, and cheap hair trimmer that is optimized for inner surfaces such as nostrils and cars.

SUMMARY OF THE INVENTION

An example embodiment for grooming may include a cylindrical handle with a bottom end, a top end, and a center axis, a housing having a minor axis, a major axis collinear with the center axis, a thru-slot, a bottom end coupled to the top end of the handle, a top end, and at least one blade located within the housing longitudinally aligned along the center axis. A variation of the example embodiment may include the housing having a prolate spheroid shape, an oval shape, an hourglass shape, a concave shape, or a convex shaped. The housing may be adapted to conform to shaving an inner surface. There may be two or more blades. The blade or plurality of blades may be removable. The handle attaches to a motorized rotational device. The thru slot may be adapted to shave a surface. The blade may have at least one edge tangential to the surface of the housing. The blade may be oriented approximately thirty degrees in relation to the tangent of the surface of the housing. The thru slot may be adapted to collect shaving debris. A variation of the example embodiment may include the handle having a cavity in communication with the thru-slot of the housing in which the hair shavings produced by the one or more blades are collected in the handle. The one or more blades may each have a blade guard that is fixed to the housing such that it rotates with the housing.

Another example embodiment for grooming may include a method of placing a shaving means against a surface, rotating the shaving means tangentially against the surface, shaving hairs from the surface, and collecting hairs from the surface in the shaving means. The example embodiment may include the shaving means being a prolate spherical housing with a plurality of longitudinal blades. The example embodiment may include inserting the shaving means into a nostril. The example embodiment may include oscillating the shaving means against the surface in a plurality of rotational directions. The example embodiment may include removing the collected hairs from the shaving means. The example embodiment may include inserting the shaving means into a nasal cavity. The example embodiment may include the surface being an inner naval cavity surface.

BRIEF DESCRIPTION OF THE DRAWINGS

For a thorough understanding of the present invention, reference is made to the following detailed description of the preferred embodiments, taken in conjunction with the accompanying drawings in which reference numbers designate like or similar elements throughout the several figures. Briefly.

DETAILED DESCRIPTION OF EXAMPLES OF THE INVENTION

In the following description, certain terms have been used for brevity, clarity, and examples. No unnecessary limitations are implied and such terms are used for descriptive purposes only and are intended to be broadly construed. The different apparatus and method steps described herein may be used alone or in combination with other systems and method steps. It is to be expected that various equivalents, alternatives, and modifications are possible within the scope of the appended claims.

Figure 1:
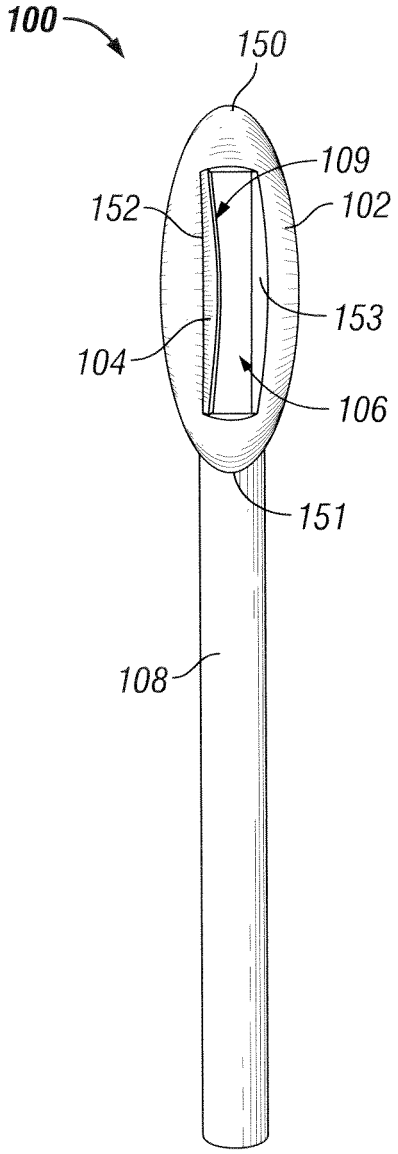
FIG. 1 is a perspective view of an example embodiment.

An example embodiment is shown in FIG. 1. The shaving apparatus 100 has a housing 102 that is a spherical prolate shaped housing. The spherical prolate has a major and minor axis. The housing 102 has two ends, a top end 150 and a bottom end 151. The bottom end 151 is coupled to a handle 108. Handle 108 is a cylinder and has a center axis that is aligned with the major axis of the housing 102. The housing 102 contains a thru-slot 106 that is rectangular in shape. However, thru-slot 106 may have different cross sectional shapes and is not limited to being rectangular. The thru-slot 106 has a first inner surface 152 and a second inner surface 153. The first inner surface 152 has a blade 104 attached. Blade 104 has a cutting edge 109.

The shaving apparatus 100 includes an ellipsoid shape housing 102. The housing 102 is not limited to this shape, it also could be spherical, cylindrical, or have an hourglass appearance. The geometrical shape of the housing 102 may be irregular and asymmetrical in its shape. The size of the housing 102 in general smaller than an adult nasal opening. The housing 102 also acts as a blade guard in this configuration, preventing the blade 104 from cutting the skin. Moreover, a blade guard may be inserted, as shown in further embodiments below, in between the housing and the blade. In this embodiment the blade guard rotates with the blade and is stationary with respect to the blade rather than the surface being shaved. The housing 102 conforms to the skin forming an optimal shaving surface as pressure is applied to the shaving surface. The blade 104 is situated in the housing 102. The housing 102 contains at least one blade 104 or it could have a series of blades 104. The blades 104 profile follows the profile of the housing 102 which acts as a guard. The blade 104 may set slightly back, flush, or slightly protrude from housing 102. The blades 104 cutting edge 109 may be convex shaped. In other embodiments the blade 104 could be straight for a cylindrical housing 102 or the blades 104 cutting edge 109 could be concaved or with a combination of two or more concave shape, convex shape, or a straight cutting edge. The blade 104 is angled in relationship to the skin in the housing 102 to have a more effective shaving angle 200. The blades 104 contact the skin to cut the hair flush to the skin surface. The blades 104 are placed in the housing 102 with the cutting edge 109 facing each other. This allows the blades 104 to shave in each direction of an oscillating motion. The center of the housing 102 has a hollow opening as represented by thru-slot 106. The thru-slot 106 captures the shaved debris and is helpful in removing debris. The thru-slot 106 allows for easy cleaning of the device. The handle 108 is cylindrical in shape and may be smaller than the housing 102. The handle 108 is attached to the housing 102. The handle 109 is rotated by a thumb and index finger in an oscillating motion to have and effective shaving action. Furthermore, the handle 109 may include a hollow opening or cavity that is in communication with thru-slot 106, such that hair shavings may be collected in the handle.

A method for using shaving apparatus 100 may include inserting the housing 102 into a nasal cavity while holding by hand the handle 108. The housing 102 is held tangent to an inner nasal surface. The handle 108 could then be rotated by hand in a single direction or oscillate between rotating clockwise and then counterclockwise. Instead of rotating by a hand a motor could be coupled to the handle, such as an electric motor contained in its own housing. In that design the electric motor could provide a single rotational direction at a single speed. The electric motor could also oscillate between the two directions of rotation at an optimal speed. The electric motor could also spin at a plurality of speeds, in a plurality of rotational directions, for optimal shaving.

Figure 2A:
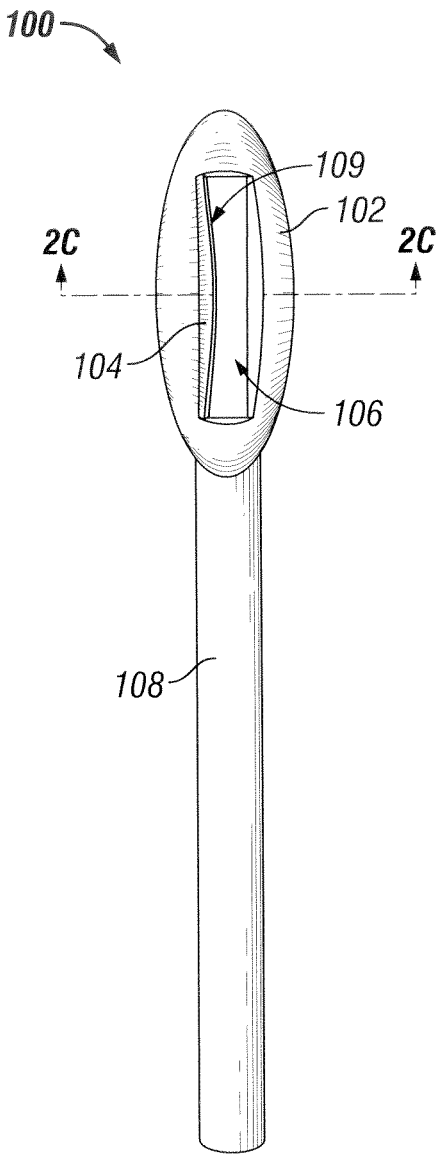
FIG. 2*a* is a perspective view of an example embodiment.
Figure 2B:
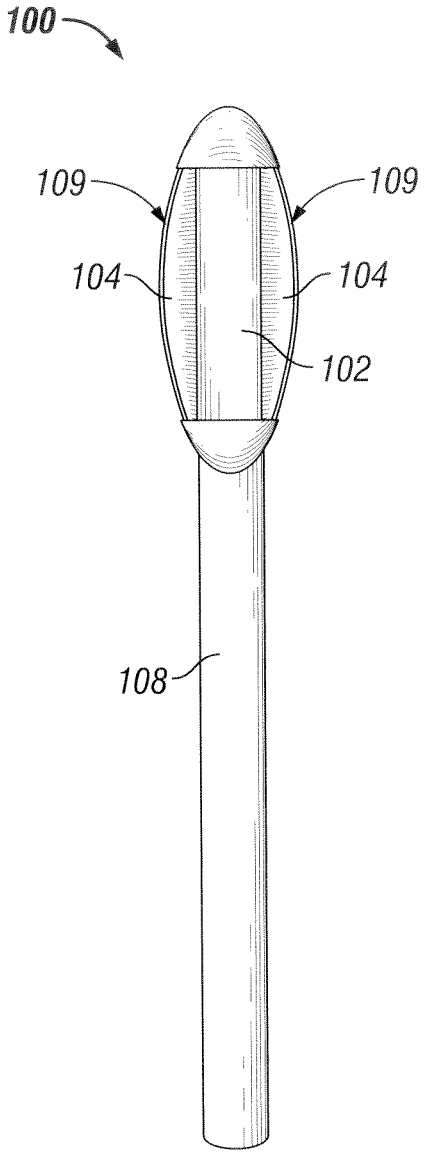
FIG. 2*b* is a perspective view of an example embodiment.

Other examples of use for shaving apparatus 100 may include other hairs on surfaces such as sideburns, ears, or eyebrows. The described uses are not intended to be limiting. Shaving apparatus 100 is shown in FIGS. 2*a* and 2*b*. The housing 102 has a thru-slot 106 that allows for at least a one blade 104 to be installed. The cutting edge 109 of blade 106 is shown protruding from the thru-slot in FIG. 2*b*, thus allowing the cutting edge 109 to cut hairs as the shaving apparatus 100 is rotated. The housing 102 is fitted to a handle 108. In this example the housing is a spherical prolate shape. In this example there is a single blade 104, however they may be a plurality of blades located within the thru-slot 106. Cross section 110 is shown in greater detail in FIG. 2*c*.

Figure 2C:
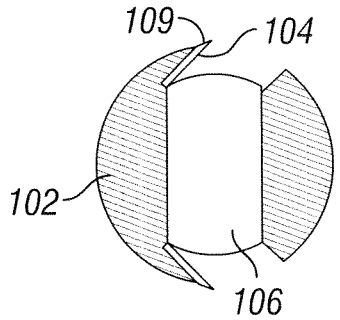
FIG. 2*c* is a cross-section view of an example embodiment.

In FIG. 2*c* the cross section of the housing 102 is shown in more detail. Housing 102 has a thru-slot 106 and in this example there are two blades 104 installed. Blades 104 are angled such that each presents a cutting edge 109 that is more or less tangent with the circular diameter the housing 102.

Figure 2D:
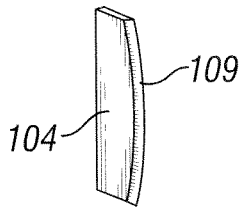
FIG. 2*d* is a perspective view of a blade used in an example embodiment.

In FIG. 2*d* an example blade 104 is shown with cutting edge 109. A single blade 104 or a plurality of blades 104 may be used in the example embodiments disclosed herein.

Figure 3:
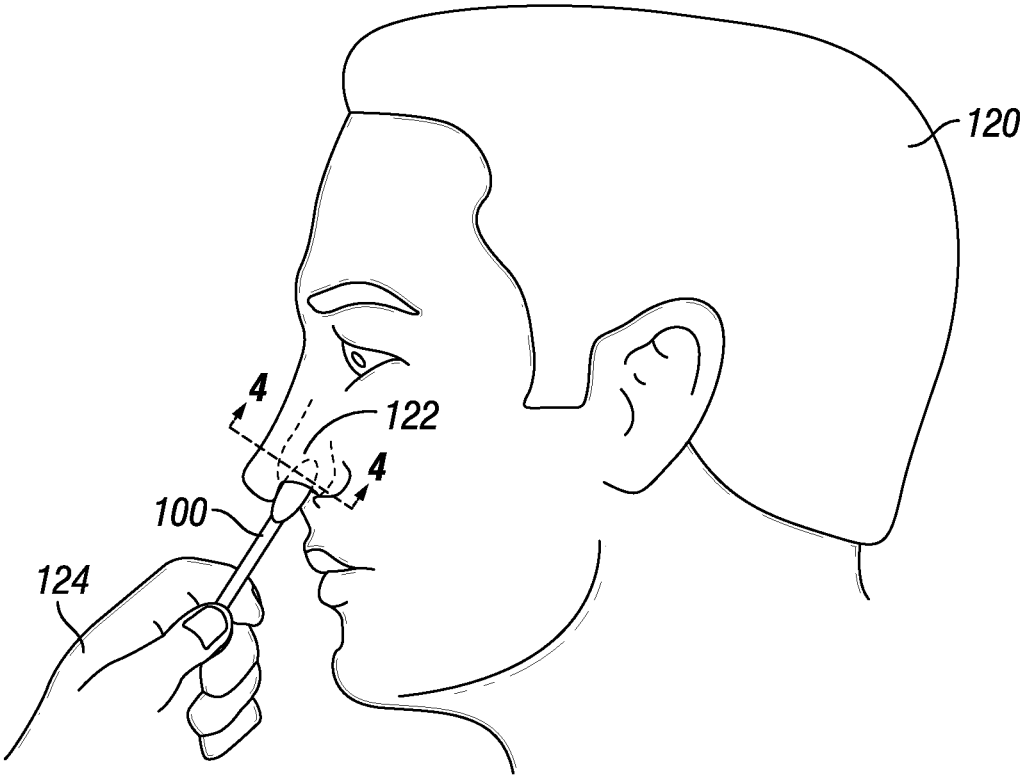
FIG. 3 is a side view of an example method of use of an example embodiment.

In FIG. 3 an example embodiment of the shaving apparatus 100 is shown in operation. The shaving apparatus 100 is inserted into the nasal cavity 122 of a housing 120 by the hand 124 and then rotated. The rotation of the shaving apparatus will cause the one or more blades 104 to trim hairs located within the nasal cavity. The rotation may be in a single direction or in an oscillating manner. The example embodiment is not limited to trimming hairs within the nasal cavity 122. It can also be used to the trim hairs on the skin surface anywhere on the body, including hairs located on the housing 120. Cross section 126 will provide more details in FIG. 4 below.

Figure 4:
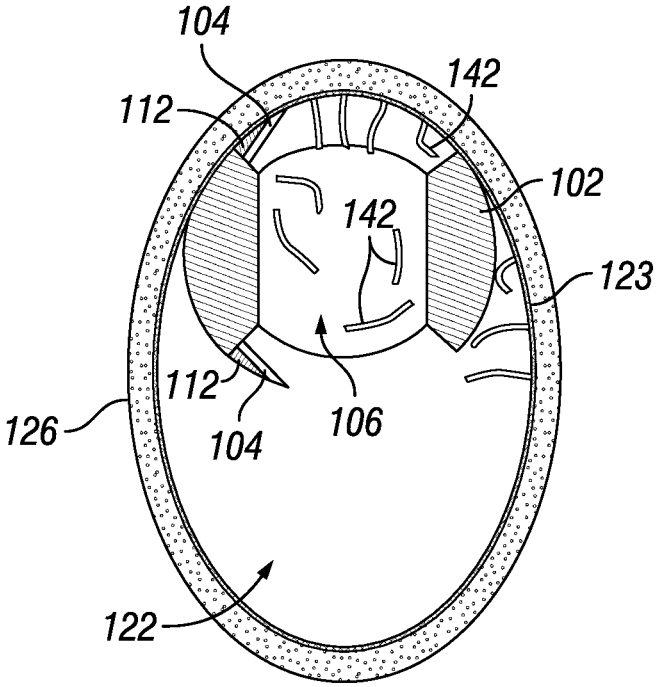
FIG. 4 is a cross-section view of an example embodiment in operation.

In FIG. 4 the nasal cross section 126 is shown. There is a nasal cavity 122 with an example embodiment of the shaving apparatus 100 inserted within. The housing 102 has blades 104 inserted into the thru-slot 106. The rotation motion of the shaving apparatus causes the blades 104 to cut nasal hairs 142 along the inner nasal surface 123. The housing has blade guards 112 to prevent the blade edge from cutting into the nasal surface 123. Blade guard 112 rotates with the housing 102 and is stationary with respect to the blades 104.

Figure 5:
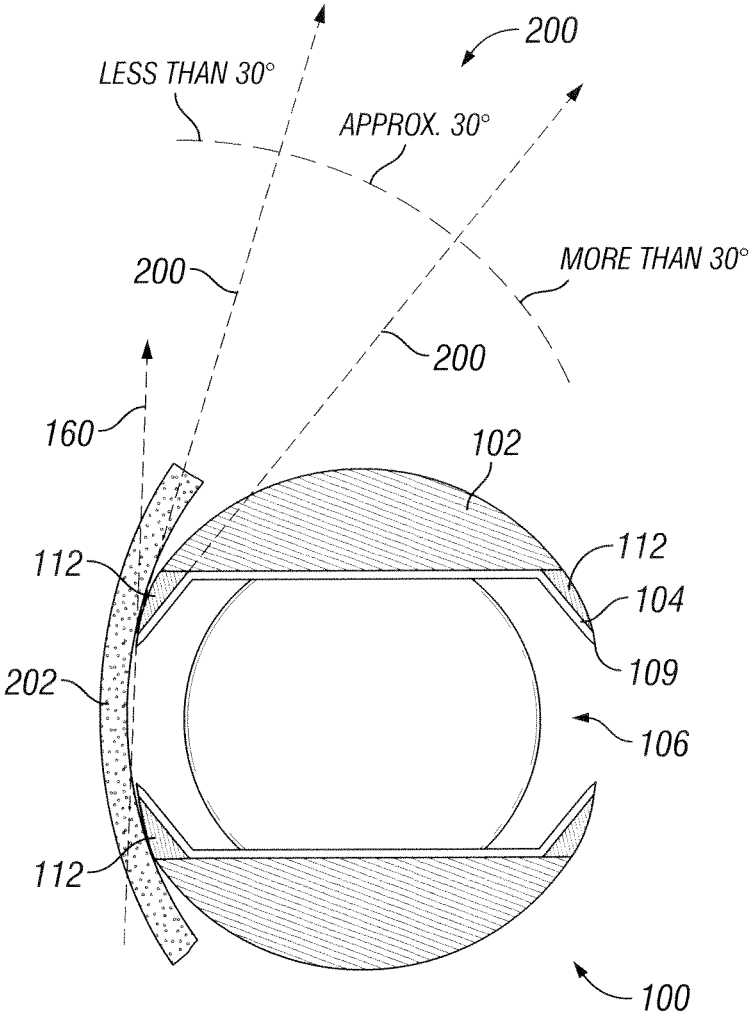
FIG. 5 is a cross-section view of an example embodiment in operation.

Another example cross section of an example embodiment is shown in FIG. 5. Here the shaving apparatus 100 has a housing 102, blades 104, a thru-slot 106, and blade guards 112. The blades 104 also have cutting edges 109. In this example the angle of the blades with respect to the tangent line 160 is shown. The effective shaving angle 200 should be approximately 30 degrees in relation to the tangent line 160. This provides an optimal shaving angle. However, angles of less than or greater than 30 degrees are possible and may also provide desired effectiveness.

Figure 6A:
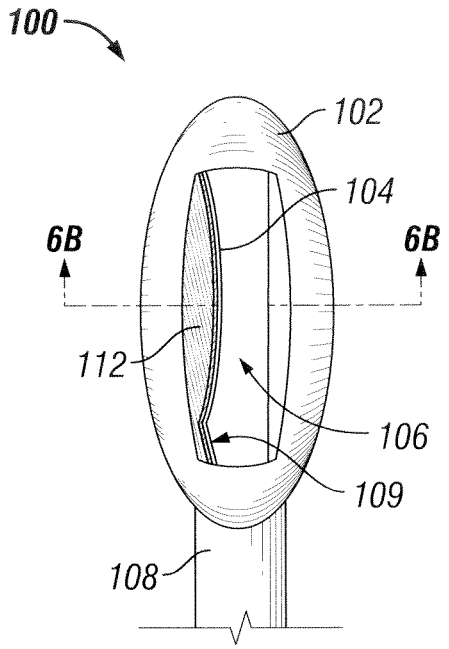
FIG. 6*a* is a perspective view of an example embodiment prolate spheroid housing.
Figure 6B:
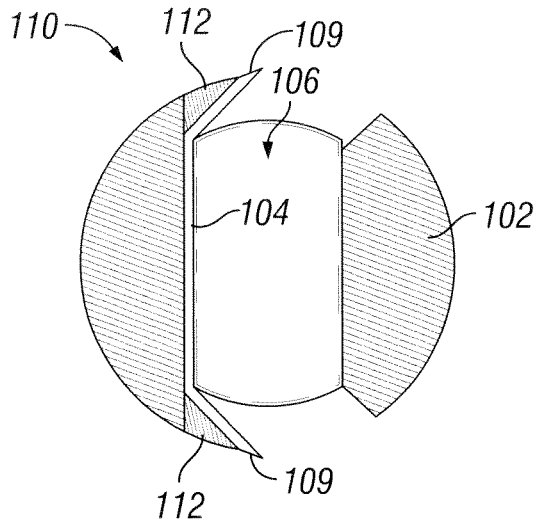
FIG. 6*b* is a cross-section view of an example embodiment prolate spheroid housing.
Figure 6C:
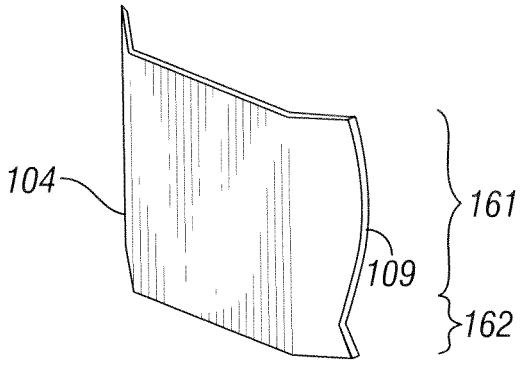
FIG. 6*c* is a perspective view of a blade for an example embodiment prolate spheroid housing.

Another example embodiment is shown in FIGS. 6*a*, 6*b*, and 6*c*. In these examples there is a shaving apparatus 100 having a housing 102, a blade 104 located in a thru-slot 106. A blade guard 112. The blade 104 has a cutting edge 109. The cross section 110 shows the blade 104 is a single piece with two cutting edges 109. The cutting edges have a convex portion 161 and a concave portion 162.

Figure 7A:
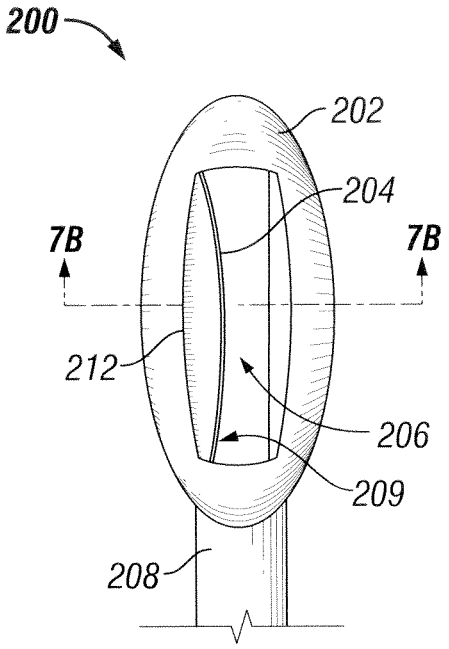
FIG. 7*a* is a perspective view of an example embodiment prolate spheroid housing.
Figure 7B:
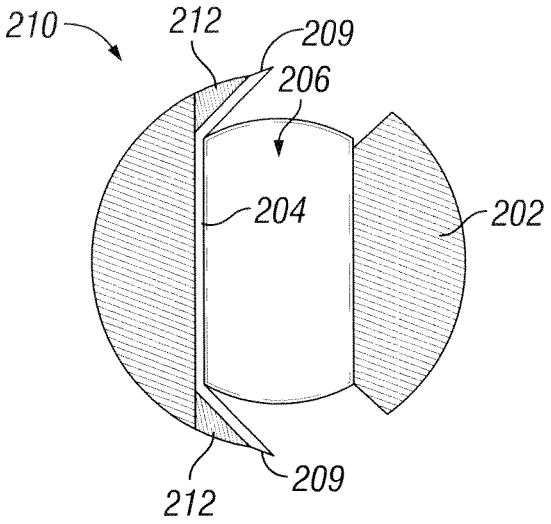
FIG. 7*b* is a cross-section view of an example embodiment prolate spheroid housing.
Figure 7C:
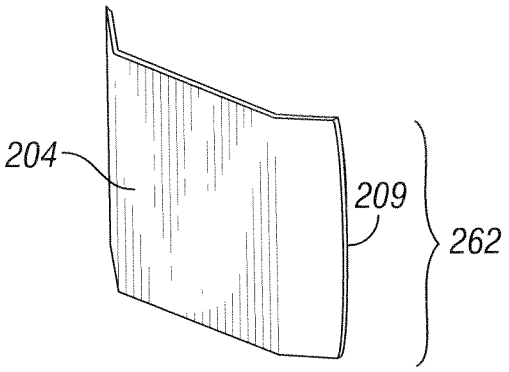
FIG. 7*c* is a perspective view of a blade for an example embodiment prolate spheroid housing.

Another example embodiment is shown in FIGS. 7*a*, 7*b*, and 7*c*. In these examples there is a shaving apparatus 200 having a housing 202, a blade 204 located in a thru-slot 206. A blade guard 212. The blade 204 has a cutting edge 209. The cross section 210 shows the blade 204 is a single piece with two cutting edges 209. The cutting edges a convex profile 262. Blade guard 212 rotates with the housing 202 and is stationary with respect to the blades 204.

Figure 8A:
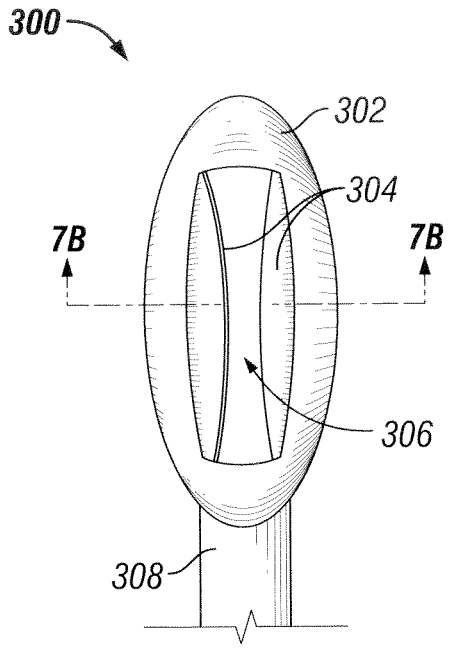
FIG. 8*a* is a perspective view of an example embodiment prolate spheroid housing.
Figure 8B:
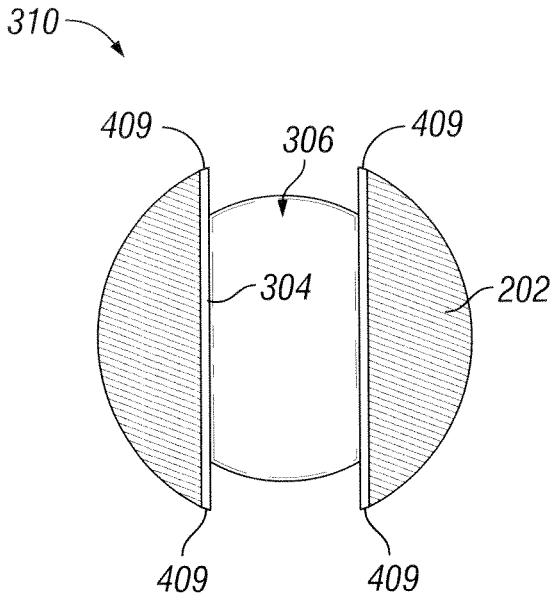
FIG. 8*b* is a cross-section view of an example embodiment prolate spheroid housing.
Figure 8C:
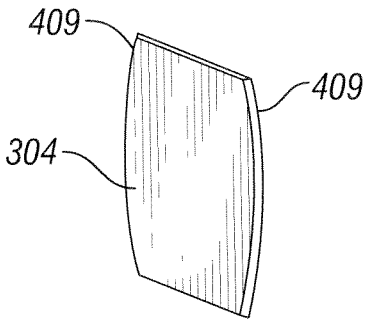
FIG. 8*c* is a perspective view of a blade for an example embodiment prolate spheroid housing.

Another example embodiment is shown in FIGS. 8*a*, 8*b*, and 8*c*. In these examples there is a shaving apparatus 300 having a housing 302, a blade 304 located in a thru-slot 306. In this example there is no separate blade guard and instead the housing 302 may provide the function of a blade guard. The blade 304 has a cutting edge 409. The cross section 310 shows the blades 304 are two separate flat pieces with four cutting edges 409. The cutting edges have a convex shape. The blades 304 have an oval shape that is truncated on the top and bottom.

Figure 9A:
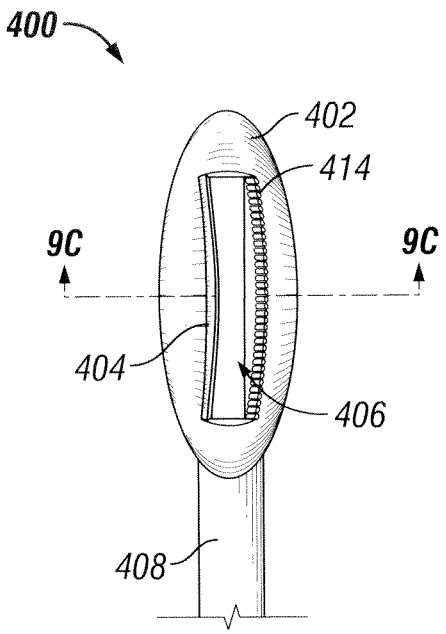
FIG. 9*a* is a perspective view of an example embodiment prolate spheroid housing.
Figure 9B:
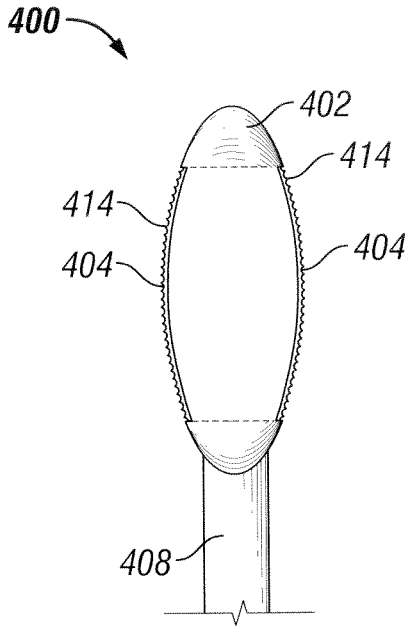
FIG. 9*b* is a perspective view of an example embodiment prolate spheroid housing.
Figure 9C:
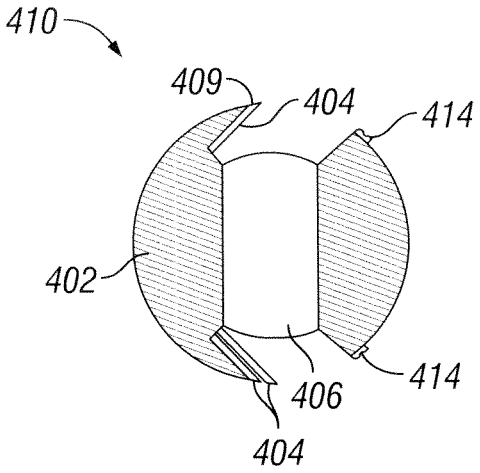
FIG. 9*c* is a cross-section view of an example embodiment prolate spheroid housing.
Figure 9D:
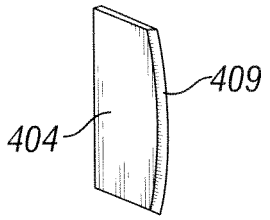
FIG. 9*d* is a perspective view of a blade for an example embodiment prolate spheroid housing.
Figure 10A:
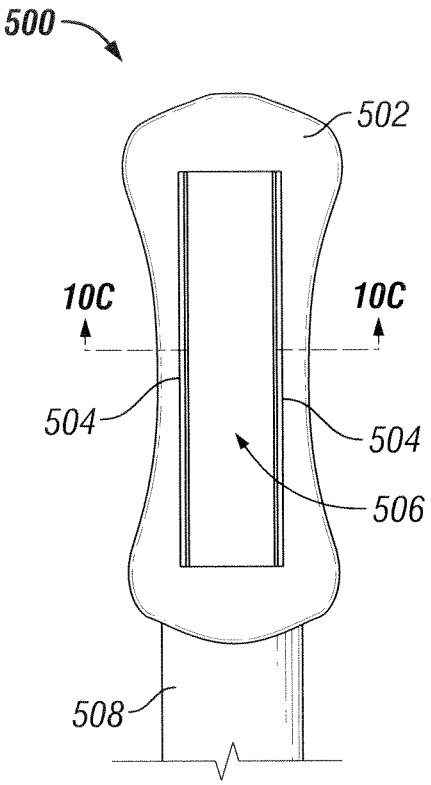
FIG. 10*a* is a perspective view of an example embodiment prolate spheroid housing.
Figure 10B:
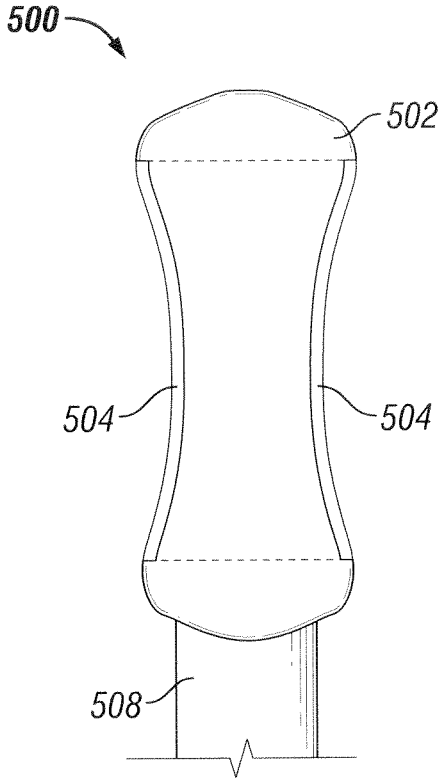
FIG. 10*b* is a perspective view of an example embodiment prolate spheroid housing.
Figure 10C:
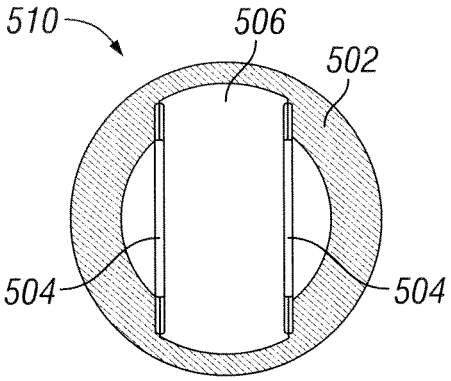
FIG. 10*c* is a cross-section view of an example embodiment prolate spheroid housing.
Figure 10D:
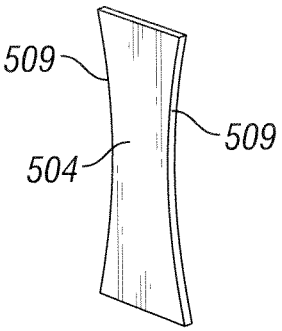
FIG. 10*d* is a perspective view of a blade for an example embodiment prolate spheroid housing.

Another example embodiment is shown in FIGS. 9*a*, 9*b*, 9*c* and 9*d*. In these examples there is a shaving apparatus 400 having a housing 402, a blade 404 located in a thru-slot 406. The housing 402 is attached to a handle 408. The blade 404 has a cutting edge 409. The cross section 410 shows the blade 404 may be a plurality of blades with a convex cutting edge 409. The housing 402 has a comb guide 414 to aid in shaving. The comb guide 414 may be a plurality of comb guides, as shown in FIG. 9*c*.

Another example embodiment is shown in FIGS. 10*a*, 10*b*, 10*c* and 10*d*. In these examples there is a shaving apparatus 500 having a housing 502, a blade 504 located in a thru-slot 506. The housing 502 is attached to a handle 508. The blade 504 has a cutting edge 509. The cross section 510 shows the blade 504 may be a plurality of blades with concave cutting edges 509. In this embodiment the housing 502 has an hour glass shape that accommodates the hour-glass shaped blades 504 with their concave cutting edges 509.

Figure 11:
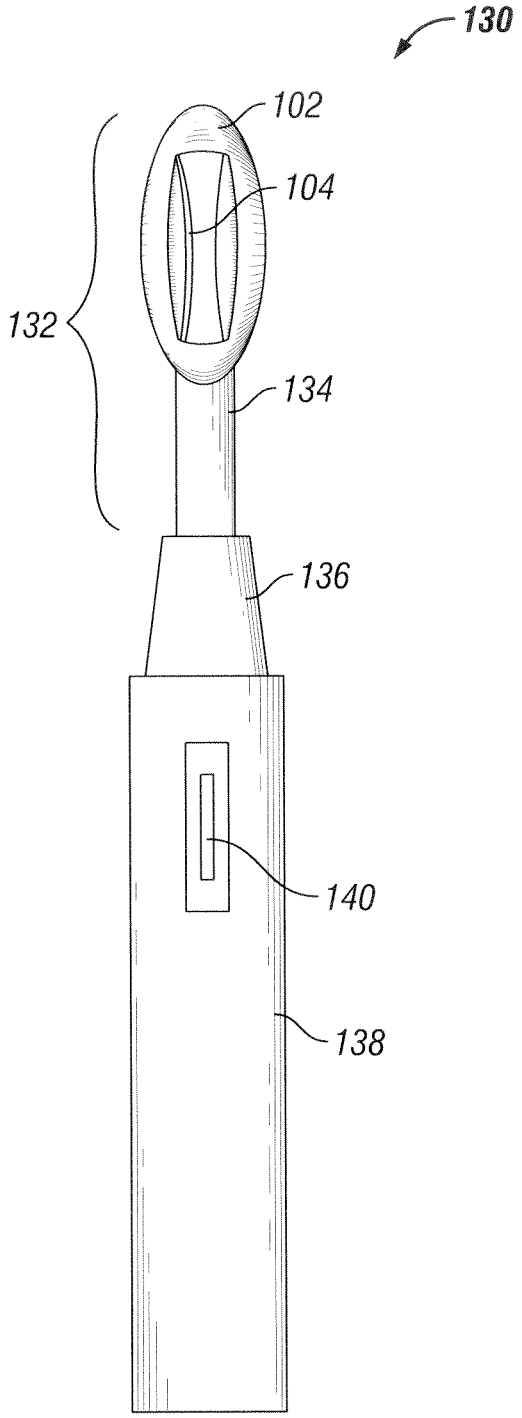
FIG. 11 is a perspective view of an example embodiment.

An example embodiment is shown in FIG. 11 wherein a motorized shaving apparatus 130 is depicted. In this configuration the housing 102 has a blade 104. The housing 102 and the shaft 134 form a shaving attachment 132. The shaving attachment 132 is connected to the motor shaft 136. The motor shaft 136 is attached to a casing 138 that contains an electric motor and a battery. There is an on/off switch 140 located on the casing 138. In this example the motor will spin in a single direction or oscillate between clockwise and counterclockwise motion of the shaving attachment 132, causing it to shave adjacent hairs. Furthermore, the shaving attachment 132 is fully interchangeable and replaceable.

Although the invention has been described in terms of particular embodiments which are set forth in detail, it should be understood that this is by illustration only and that the invention is not necessarily limited thereto. Alternative embodiments and operating techniques will become apparent to those of ordinary skill in the art in view of the present disclosure. Accordingly, modifications of the invention are contemplated which may be made without departing from the spirit of the claimed invention.

What is claimed is:

1. An apparatus for grooming comprising:

a cylindrical handle with a bottom end, a top end, and a center axis;

a prolate shaped housing having an outer surface, a minor axis, a major axis coilinear with the center axis, an elongated thru-slot aligned with the major axis forming two openings on the prolate shaped housing positioned 180 degrees opposite about the center axis, and at least one removable blade located within the thru-slot the blade having a cutting surface substantially parallel with the center axis such that the blade can cut in a rotational motion about the center axis, with the cutting surface in contact with the outer surface of the prolate shaped housing and angled to shave along the outer surface of the housing when rotating about the major axis, wherein the thru-slot is sized such that hair can fully extend within the thru-slot prior to contact with the at least one blade and the blade cuts along a surface in contact with the housing outer surface as the housing is rotated;

a blade guard located adjacent to the at least one blade and further adjacent to one side of the opening of the thru-slot, wherein the blade guard and the at least one blade rotate together; and a comb guide located adjacent to the opening opposite to the one side of the opening and aligned with the blade guard along the outer surface of the housing.

2. The apparatus of claim 1, wherein the housing is oval shaped.

3. The apparatus of claim 1, wherein the housing is hourglass shaped.

4. The apparatus of claim 1, wherein the housing is concave shaped.

5. The apparatus of claim 1, wherein the housing is convex shaped.

6. The apparatus of claim 1, wherein the housing is adapted to conform to shaving an inner nasal surface.

7. The apparatus of claim 1, wherein the at least one blade is two blades.

8. The apparatus of claim 1, wherein the at least one blade is four blades.

9. The apparatus of claim 1, wherein the handle is rotated by an electric motor.

10. The apparatus of claim 1, wherein the at least one blade has at least one edge tangent to the surface of the housing.

11. The apparatus of claim 1, wherein the thru-slot is adapted to collect shaving debris.

12. The apparatus of claim 1, wherein the at least one removable blade's cutting surface is oval shaped.

13. The apparatus of claim 1, wherein the at least one removable blade's cutting surface is straight and parallel with the center axis.

14. The apparatus of claim 1, wherein the at least one removable blade's cutting surface is concave shaped.

15. The apparatus of claim 1, wherein the at least one removable blade's cutting surface is convex shaped.

16. The apparatus of claim 1, wherein the at least one removable blade's cutting surface is arched shaped.

17. The apparatus of claim 1, wherein the thru slot allows the hair being shaven to stand fully perpendicular to its shaving surface prior to contact with the at least one removable blade.

* * * * *